US005991971A

United States Patent [19]

Downham

[11] Patent Number: 5,991,971

[45] Date of Patent: Nov. 30, 1999

[54] SUCTION CLEANER

[75] Inventor: David William Downham, Flitwick, United Kingdom

[73] Assignee: Aktiebolaget Electrolux, Stockholm, Sweden

[21] Appl. No.: 09/015,648

[22] Filed: Jan. 29, 1998

[30] Foreign Application Priority Data

Jan. 31, 1997 [GB] United Kingdom ..... 9702062

[51] Int. Cl.[6] ..... A47L 5/32

[52] U.S. Cl. ..... 15/339; 15/334

[58] Field of Search ..... 15/339, 331, 334

[56] References Cited

U.S. PATENT DOCUMENTS

| | | | |
|---|---|---|---|
| 1,167,219 | 1/1916 | Replogle | 15/335 |
| 2,597,690 | 5/1952 | Wied | 15/339 X |
| 2,847,084 | 8/1958 | Wolfskill et al. | 15/339 X |
| 2,910,717 | 11/1959 | Raymond | 15/339 X |
| 3,911,524 | 10/1975 | Parise | 15/321 X |
| 3,939,527 | 2/1976 | Jones | 15/321 X |
| 4,571,772 | 2/1986 | Dyson | 15/335 |
| 4,748,713 | 6/1988 | Sepke et al. | 15/351 X |
| 4,959,885 | 10/1990 | Sovis et al. | 15/335 |
| 5,168,598 | 12/1992 | Hashizume et al. | 15/351 X |
| 5,477,586 | 12/1995 | Jacobs et al. | 15/335 X |
| 5,564,160 | 10/1996 | Luebbering | 15/351 |

*Primary Examiner*—Chris K. Moore

*Attorney, Agent, or Firm*—Pearne, Gordon, McCoy & Granger LLP

[57] ABSTRACT

A suction cleaner includes a base unit (1) and a body unit (2) mounted on the base unit. The base unit (1) incorporates a downwardly-facing suction opening (1*a*) and the body unit (2) houses a dust-collection receptacle. The body unit (2) is provided with a pipe (7) for delivering dust-laden air from the base unit (1) to the dust-collection receptacle. The pipe (7) is made of a transparent material and is detachably mounted on the cleaner.

5 Claims, 1 Drawing Sheet

SUCTION CLEANER

BACKGROUND OF THE INVENTION

This invention relates to a suction cleaner, and in particular to an upright suction cleaner.

An upright suction cleaner typically includes a base unit, a rigid upright body mounted on the base unit, and a handle. The base unit includes ground wheels or rollers, a suction opening confronting the floor to be cleaned, and a rotary beater disposed in the suction opening for beating the region of the floor confronting the suction opening. The rigid upright body houses a dust bag and a motor/fan unit. In use, the fain draws dust-laden air through the suction opening, and delivers it to the dust bag via a pipe positioned in the upright body.

A problem with this type of cleaner is that dirt tends to clog in the pipe leading from the base unit to the dust bag, and this leads to reduced pick-up of dirt and hence reduced cleaning efficiency. Once the pipe is clogged with dirt, it is necessary to dismantle the machine to clear the clog.

SUMMARY OF THE INVENTION

The present invention provides a suction cleaner comprising a base unit and a body unit mounted on the base unit, the base unit incorporating a downwardly-facing suction opening, and the body unit housing a dust-collection receptacle, the body unit being provided with a pipe delivering dust-laden air from the base unit to the dust-collection receptacle, wherein the pipe is made of a transparent material and is detachably mounted on the body unit.

BRIEF DESCRIPTION OF THE DRAWINGS

One form of suction cleaner constructed in accordance with the invention will now be described in detail by way of example, with reference to the drawings, in which.

DETAILED DESCRIPTION OF THE PREFERRED EMBODIMENT

Figure 1:
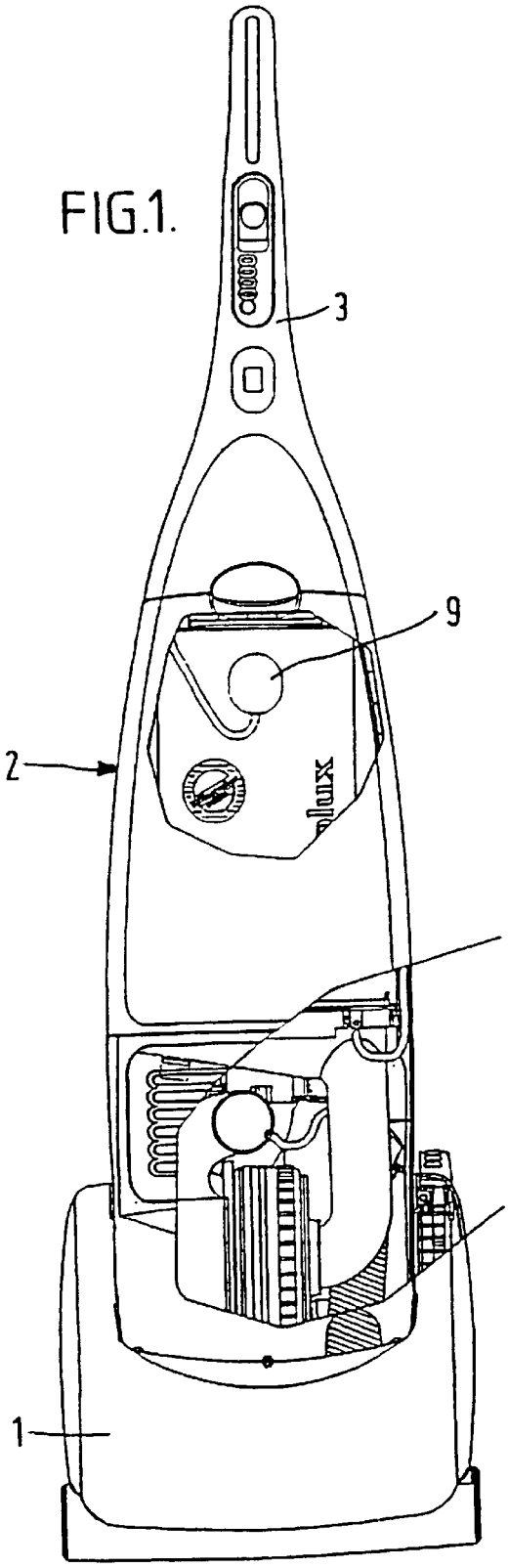
FIG. 1 is a front elevation of the cleaner.
Figure 2:
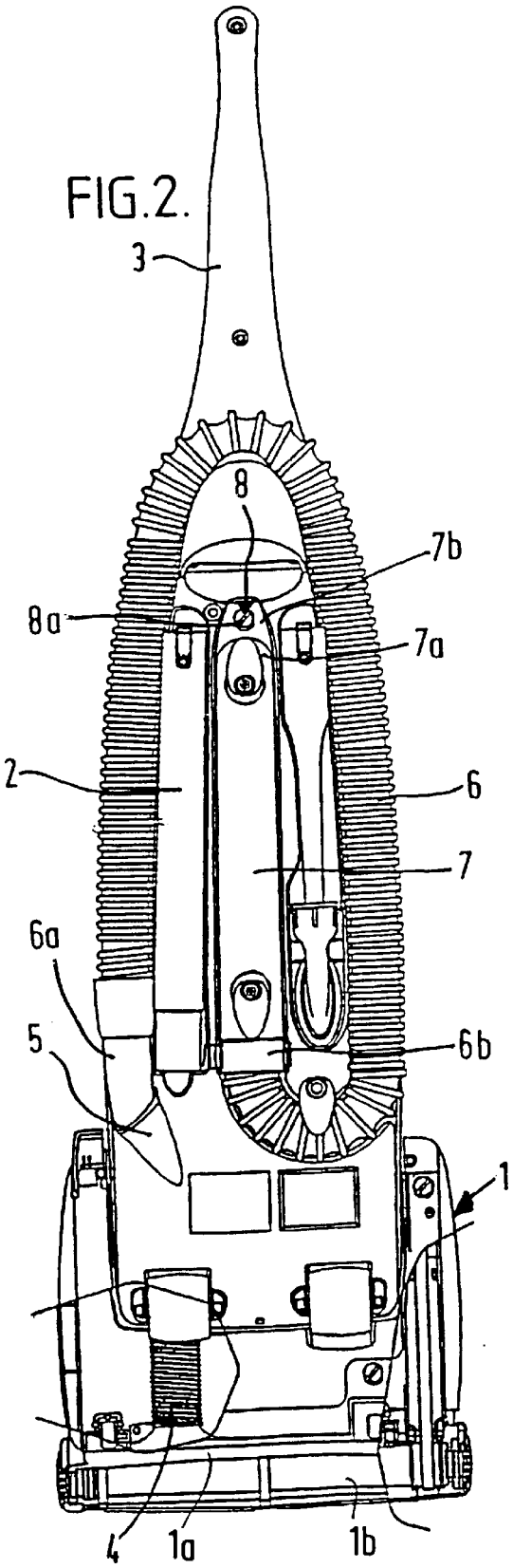
FIG. 2 is a rear elevation of the cleaner.

Referring to the drawings, the cleaner comprises a base unit 1, a rigid upright body 2 and a handle 3. The base unit 1 includes ground wheels or rollers, a suction opening 1*a* confronting the floor to be cleaned, and a rotary beater 1*b* disposed in the suction opening for beating the region of the floor confronting the suction opening. All these items are conventional, and so will not be described in detail. The base unit I also includes a flexible air duct 4 leading from the suction opening 1*a* to an outlet 5 formed in the lower portion of the upright body 2.

A motor (not shown) is housed in the lower portion of the upright body 2, the motor being provided with a suction En (not shown) for drawing in air through the suction opening and the air duct 4. The motor and the suction fan are conventional, and so will not be described in detail The upper portion of the upright body 2 houses a conventional dust bag (not shown). Dust-laden air is delivered to the dust bag from the air duct 4 via the outlet 5, a flexible hose 6 and a transparent pipe 7 made of polycarbonate. The hose 6 has a rigid end portion 6*a* which is a sealing fiction fit within the outlet 5. The other end of the hose 6 is provided with a rigid collar 6*b* which seals against the lower end of the pipe 7. The upper end of the pipe 7 is formed with a laterally-extending end-piece 7*a* which leads to the dust bag via internal ducting 9 formed in the upright body 2. The end-piece 7*a* forms an air-tight seal within the ducting 9. The upper end of the pipe 7 is provided with an upwardly-extending flange 7*b* which supports a locking member 8. The locking member 8 has a shaft which is rotatably mounted in an aperture in the flange 7*b,* a slotted head 8*a* facing outwardly, and a locking projection (not shown) facing inwardly. In use, the head 8*a* can be rotated (for example by engagement with a coin) to locate the projection behind a slot (not shown) in the upright body 2 to lock the pipe 7 in position against the body, or to align the projection with the slot to enable the pipe to be removed from the body.

In use, if the cleaner suffers from reduced pick-up, it will be readily apparent if this is caused by a blockage in the pipe 7, as this pipe is transparent. It is then a simple job to remove the pipe 7 by releasing the locking member 8, and tilting the pipe away from the upright body 2. The blockage can then be removed, the lower end of the pipe 7 re-engaged with the collar 6*b* of the tube 6, and the pipe locked back into position with its laterally-extending end-piece 7*a* engaging within the ducting 9.

I claim:

1. A suction cleaner comprising a base unit, a hose, and a body unit mounted on the base unit, the base unit incorporating a downwardly-facing suction opening and an air duct leading from the suction opening to an outlet formed in the base unit, the body unit housing a dust-collection receptacle, the body unit being provided with a pipe for delivering dust-laden air from the base unit to the dust-collection receptacle, said hose having a first end sealing connected with the base unit outlet and a second end sealingly connected with a first end of said pipe, wherein the pipe is made of a transparent material and has a second end that is releasably and positively attached to the body unit.

2. A suction cleaner as claimed in claim 1, wherein the hose has a releasable sealing friction fit with the outlet.

3. A suction cleaner as claimed in claim 1 or claim 2, wherein the second end of the pipe forms a releasable air-tight seal with ducting leading to the dust-collection receptacle.

4. A suction cleaner as claimed in claim 3, wherein the second end of the pipe is releasably and positively attached to the body unit by means of a rotary locking member.

5. A suction cleaner as claimed in claim 4, wherein, when the rotary locking member is in a first position, the second end of the pipe is positively affixed to the body unit and, when the rotary locking member is in a second position, the second end of the pipe is released and movable relative to the body unit.

* * * * *